US010295279B2

(12) United States Patent
Mayo

(10) Patent No.: US 10,295,279 B2
(45) Date of Patent: May 21, 2019

(54) HEAT EXCHANGER

(71) Applicant: Hamilton Sundstrand Corporation, Windsor, CT (US)

(72) Inventor: Luke J. Mayo, Coventry, CT (US)

(73) Assignee: HAMILTON SUNDSTRAND CORPORATION, Windsor Locks, CT (US)

( * ) Notice: Subject to any disclaimer, the term of this patent is extended or adjusted under 35 U.S.C. 154(b) by 562 days.

(21) Appl. No.: 14/947,361

(22) Filed: Nov. 20, 2015

(65) Prior Publication Data

US 2017/0146304 A1 May 25, 2017

(51) Int. Cl.

| | |
|---|---|
| ***F28F 9/02*** | (2006.01) |
| ***F28D 9/00*** | (2006.01) |
| *F28D 21/00* | (2006.01) |

(52) U.S. Cl.

CPC ..... *F28F 9/02* (2013.01); *F28D 9/00* (2013.01); *F28F 9/0251* (2013.01); *F28D 2021/0021* (2013.01); *F28F 2009/029* (2013.01)

(58) Field of Classification Search

CPC ..... F28F 9/02
USPC ..... 285/179
See application file for complete search history.

(56) References Cited

U.S. PATENT DOCUMENTS

| | | | | | |
|---|---|---|---|---|---|
| 186,855 | A * | 1/1877 | Leland | F16L 33/225 | 285/179 |
| 303,656 | A * | 8/1884 | Metzger et al. | F16L 37/008 | 251/300 |
| 388,112 | A * | 8/1888 | Bodycomb | F16L 27/093 | 285/179 |
| 2,292,328 | A * | 8/1942 | Sisk | E03C 1/122 | 285/125.1 |
| 2,443,993 | A * | 6/1948 | Schenkelberger | F16L 27/0845 | 277/402 |
| 4,280,721 | A * | 7/1981 | Narkon | F16L 41/007 | 285/179 |
| 4,702,274 | A * | 10/1987 | Kramer | E03F 3/04 | 137/515.5 |
| 5,944,985 | A * | 8/1999 | Bowman | B01D 61/08 | 210/153 |

* cited by examiner

*Primary Examiner* — Aaron M Dunwoody
*Assistant Examiner* — Fannie C Kee
(74) *Attorney, Agent, or Firm* — Cantor Colburn LLP

(57) ABSTRACT

An end cap configured for use with a recirculation heat exchanger of an aircraft environmental control system includes a body having an inlet section adjacent an inlet end, an outlet section adjacent an outlet end, and a transition section fluidly coupling the inlet section and the outlet section. The inlet section includes a generally rounded portion having a radius of about 0.870 inches (2.21 cm) and at least one flange formed at a side of the rounded portion. An exterior of the flange is positioned at a distance of about 1.012 from an origin of the rounded portion.

11 Claims, 5 Drawing Sheets

HEAT EXCHANGER

BACKGROUND OF THE INVENTION

Exemplary embodiments of this invention generally relate to environmental control systems of an aircraft and, more particularly, to a recirculation heat exchanger of such an environmental control system.

Environmental control systems (ECS) for aircrafts and other vehicles are utilized to provide a conditioned airflow for passengers and crew within an aircraft. One type of environmental control system generally operates by receiving fresh air into a ram air intake located near the ECS equipment bay. The fresh ram air is supplied to at least one electric motor-driven air compressor that raises the air pressure to, for example, the desired air pressure for the cabin. From at least one air compressor, the air is supplied to an optional ozone converter. Because air compression creates heat, the air is then supplied to an air conditioning pack in which the air is cooled before being transported to the cabin.

The air exhausted from the cabin, also referred to as recirculation air, is provided to a recirculation heat exchanger where the air is cooled before being mixed with cool fresh air and returned to the cabin. As the size of aircraft cabins increase, the demands placed on the ECS also increase. A conventional ECS has difficulty meeting the greater cooling requirements of such an aircraft.

BRIEF DESCRIPTION OF THE INVENTION

According to one embodiment of the invention, an end cap configured for use with a recirculation heat exchanger of an aircraft environmental control system includes a body having an inlet section adjacent an inlet end, an outlet section adjacent an outlet end, and a transition section fluidly coupling the inlet section and the outlet section. The inlet section includes a generally rounded portion having a radius of about 0.870 inches (2.21 cm) and at least one flange formed at a side of the rounded portion. An exterior of the flange is positioned at a distance of about 1.012 from an origin of the rounded portion.

BRIEF DESCRIPTION OF THE DRAWINGS

The subject matter, which is regarded as the invention, is particularly pointed out and distinctly claimed in the claims at the conclusion of the specification. The foregoing and other features, and advantages of the invention are apparent from the following detailed description taken in conjunction with the accompanying drawings in which:

The detailed description explains embodiments of the invention, together with advantages and features, by way of example with reference to the drawings.

DETAILED DESCRIPTION OF THE INVENTION

Figure 1:
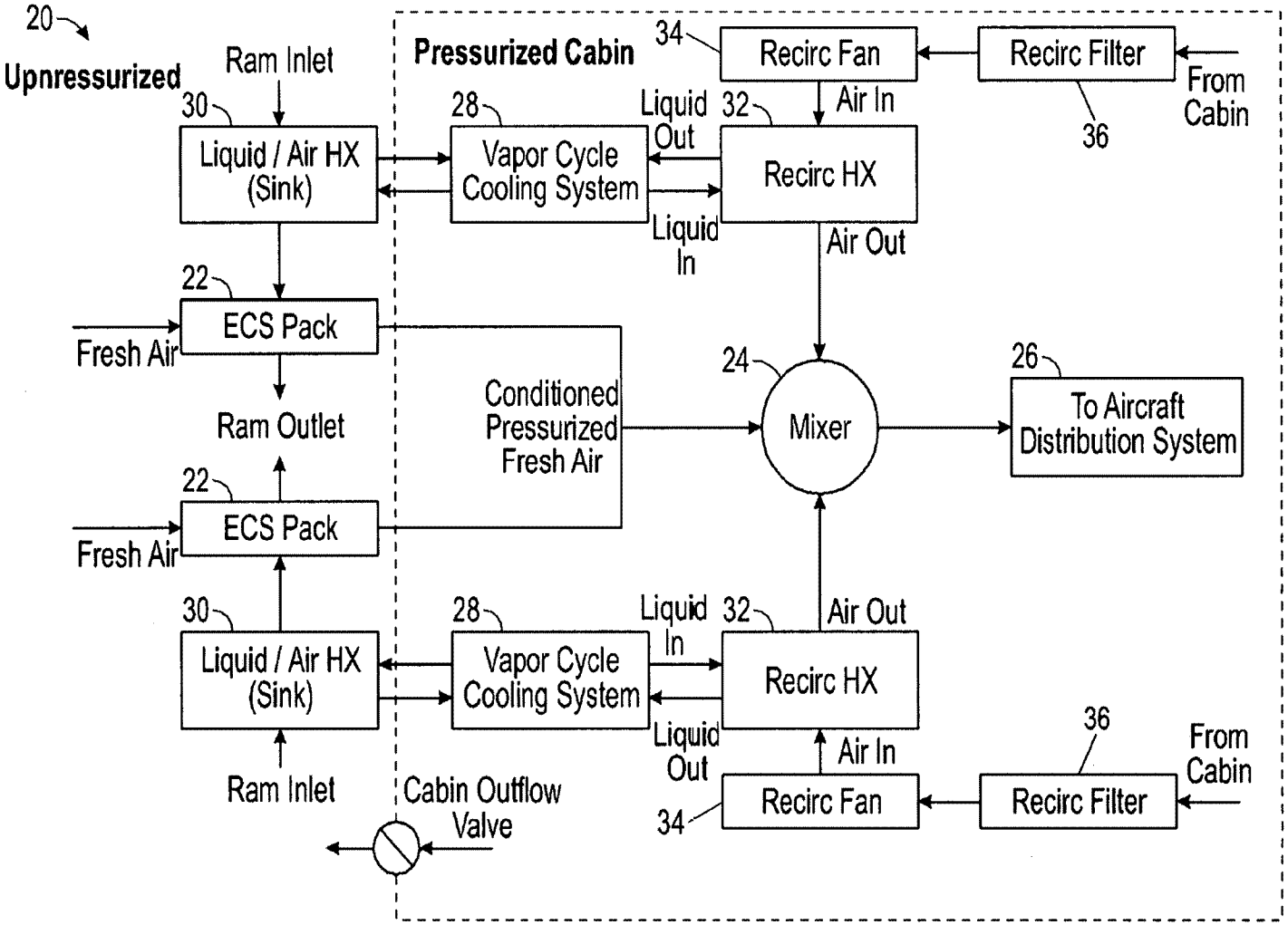
FIG. 1 is a schematic diagram of a portion of an environmental control system (ECS) of an aircraft.

Referring now to FIG. 1, a schematic diagram of an example of an environmental control system (ECS) 20 of an aircraft is illustrated in more detail. The ECS 20 is configured to receive air from both an exterior of the aircraft, as fresh ram air, and from the aircraft fuselage or another interior space as recirculation air. Fresh ram air is supplied to an ECS pack 22 including a plurality of conventional components including at least one heat exchanger (not shown). Within the ECS pack 22, the fresh air is conditioned via heat exchange with ram air such that cool pressurized air is provided to a downstream mixer 24 and then to an aircraft distribution system 26.

Before being provided to the ECS pack 22, the ram air is configured to pass through a heat exchanger 30 of a vapor cooling circuit 28. Within the heat exchanger 30, the ram air is configured to absorb heat, thereby cooling the liquid within the vapor cooling circuit 28. The vapor cooling circuit 28 additionally includes a recirculation heater exchanger 32.

A majority of the recirculation air is transferred from a cabin back to the ECS 20 using a recirculation fan 34. The recirculation fan 34 is configured to draw the recirculation air through a filter 36 before supplying the recirculation air to the recirculation heat exchanger 32 for cooling. The cooled recirculation air leaves the recirculation heat exchanger 32 and is then mixed with the fresh air being supplied to the aircraft distribution system 26.

Figure 2:
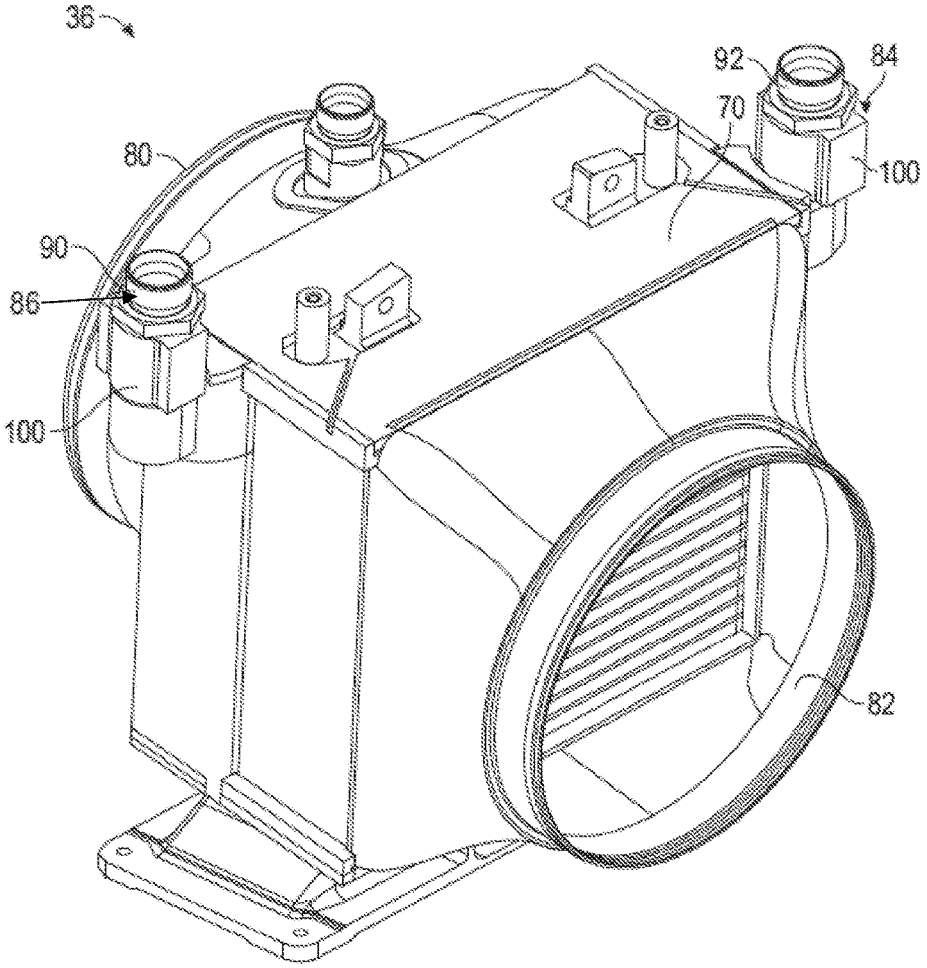
FIG. 2 is a perspective view of a recirculation heat exchanger of an ECS according to an embodiment.
Figure 3:
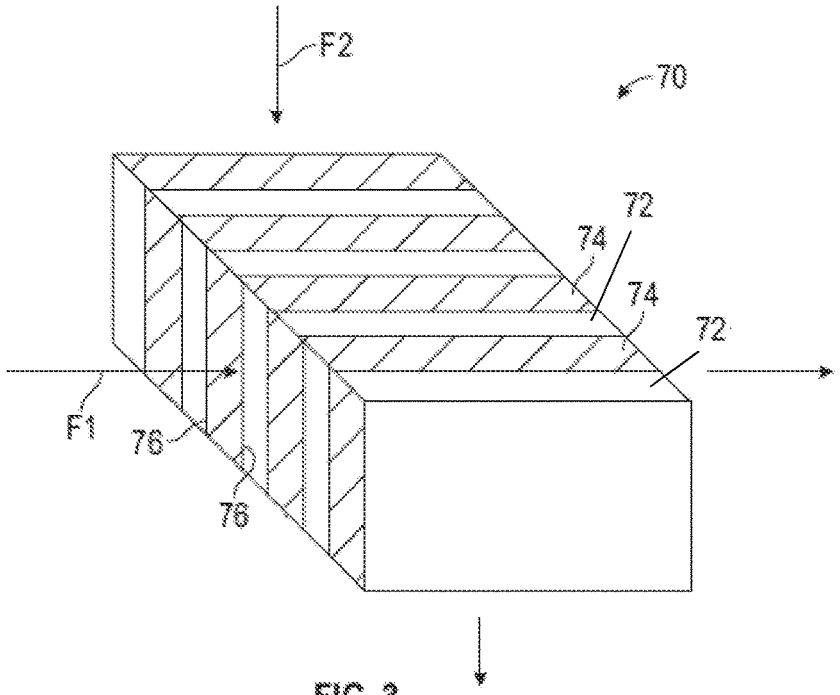
FIG. 3 is a perspective view of a core of the recirculation heat exchanger of FIG. 2 according to an embodiment.
Figure 4:
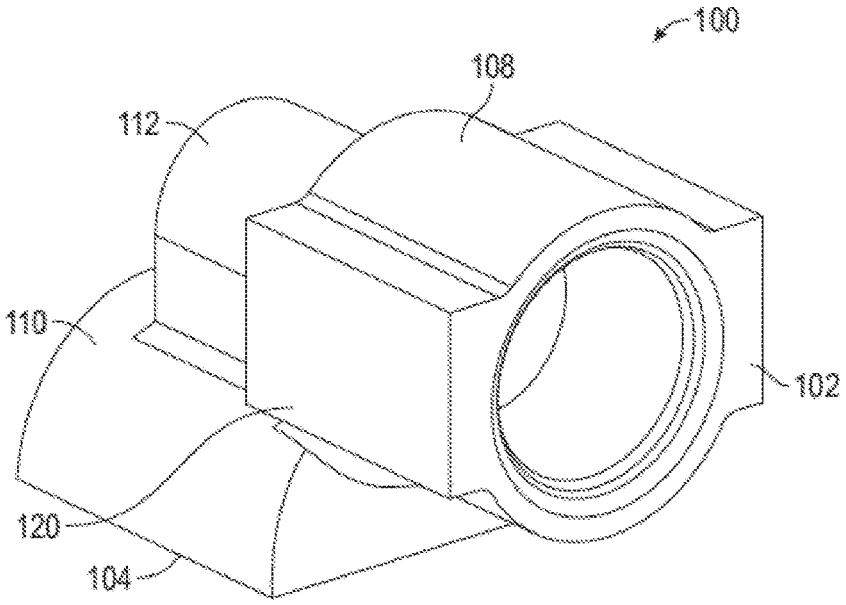
FIG. 4 is a perspective view of an end cap fitting according to an embodiment.
Figure 6:
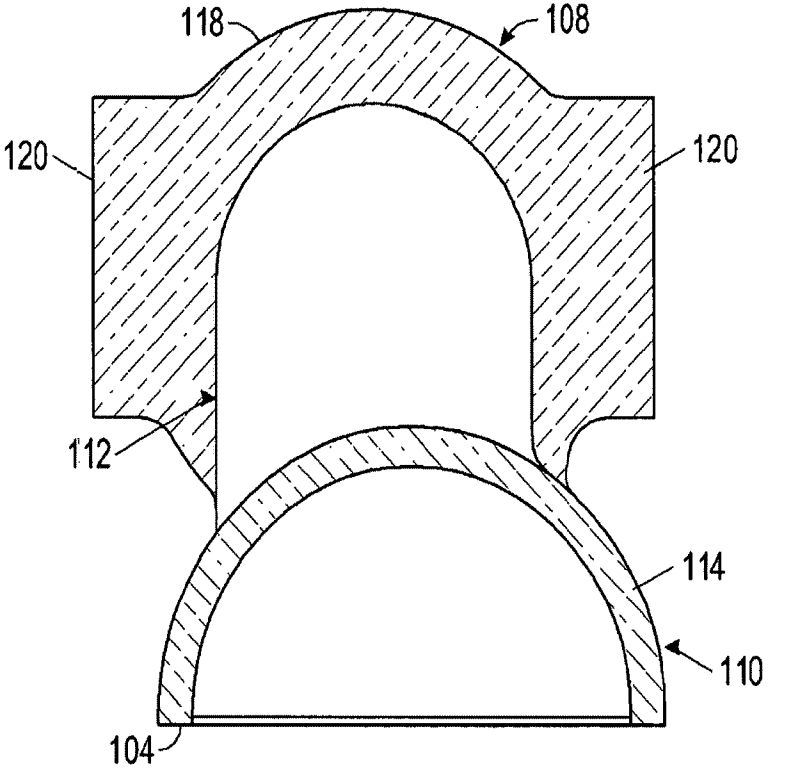
FIG. 6 is a bottom view of the end cap fitting of FIG. 4 according to an embodiment.

Referring now to FIGS. 2 and 3, an example of a recirculation heat exchanger 36 is illustrated in more detail. The recirculation heat exchanger 36 is generally rectangular in shape and includes a core 70 having a plate-fin construction with crossflow of a first warm fluid (air) and a second cool fluid there through. The core 70 of the heat exchanger 36 includes a plurality of first fluid layers 72 and second fluid layers 74. The first fluid layers 72 have a fluid pathway defined by a plurality of corrugated fins such that a first fluid, such as warm recirculation air for example, flows through the core 70 in a first direction, indicated by arrow F1. The second fluid layers 74 have a fluid pathway defined by a plurality of corrugated fins such that a second fluid, for example liquid coolant, flows through the core 70 in a second direction, indicated by arrow F2. In one embodiment, the direction of the second fluid flow is substantially perpendicular to the direction of the first fluid flow. The first and second fluid layers 72, 74 are alternately stacked to form the core. Thin plates 76 may separate adjacent fluid layers 72, 74.

An air inlet 80 and an air outlet 82 are arranged in fluid communication with the plurality of first fluid layers 72 of the core 70. Similarly, a liquid inlet 84 and a liquid outlet 86 are arranged in fluid communication with the plurality of second fluid layers 74 of the core 70 such that heat is configured to transfer from the recirculation air to the liquid within the heat exchanger 36. As illustrated, the air inlet 80 and the air outlet 82 are disposed adjacent opposite surfaces, such as a front and back of the core 70 for example. However, in other embodiments, such as where the air flow within the heat exchanger 36 has a multi-pass configuration, the air inlet 80 and the air outlet 82 may be located adjacent the same surface of the core 70. Similarly, the liquid inlet 84 and the liquid outlet 86 illustrated in FIG. 2 are arranged adjacent opposing surfaces of the core 70, for example, a right side and left side of the core 70, respectively. However, in other embodiments, such as where the liquid flow path through the heat exchanger 36 has a multi-pass configuration, the liquid inlet 84 and liquid outlet 86 may be arranged on the same side of the core 70.

Both the liquid inlet 84 and the liquid outlet 86 arranged in fluid communication with the plurality of second fluid layers 74 of the core 70 include an end cap 100. The end caps 100 are configured to provide a transition or interface between a fitting 90, 92 and the headers (not shown) coupled to the core 70.

An example of an end cap 100 is illustrated in more detail in FIGS. 4-8. The end caps 100 mounted at the liquid inlet 84 and liquid outlet 86 may, but need not be the same. As shown, an inlet end 102 and an outlet end 104 of the end cap 100 are arranged perpendicular to one another. The end cap 100 includes an inlet section 108 adjacent the inlet end 102, an outlet section 110 adjacent the outlet end 104, and a transition section 112 fluidly coupling the inlet and outlet sections 108, 110. As shown best in FIG. 7, the overall length of the end cap 100 extending between the inlet end 102 and the furthest surface 114 of the end cap 100 arranged in a plane parallel to the inlet end 102 is about 3.363 inches (9.22 cm). The length of the end cap 100 extending between the inlet end 102 and the furthest surface of the transition section 112 arranged in a plane parallel to the inlet end 102 is about 2.863 inches (7.27 cm). The length of the inlet section 108 is about 1.613 inches (4.097 cm). A portion of the outlet section 110 overlaps with the inlet section 108 such that the distance between the inlet end 102 and an adjacent corner 116 of the outlet end 104 is about 1.342 inches (3.409 cm). In one embodiment, the corner 116 is arranged at an angle of about 10° relative to the plane of the inlet end 102.

Figure 5:
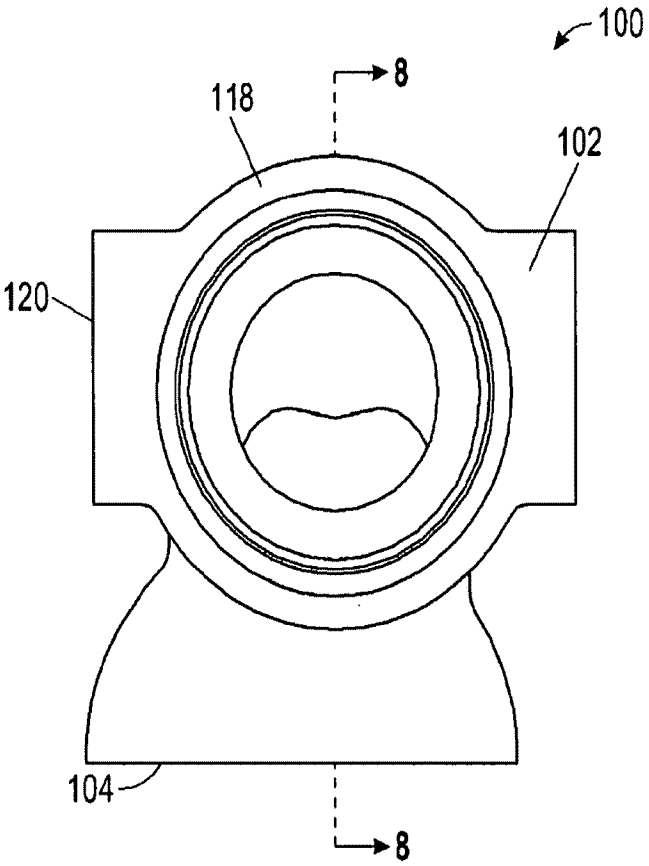
FIG. 5 is a top view of the end cap fitting of FIG. 4 according to an embodiment.
Figure 8:
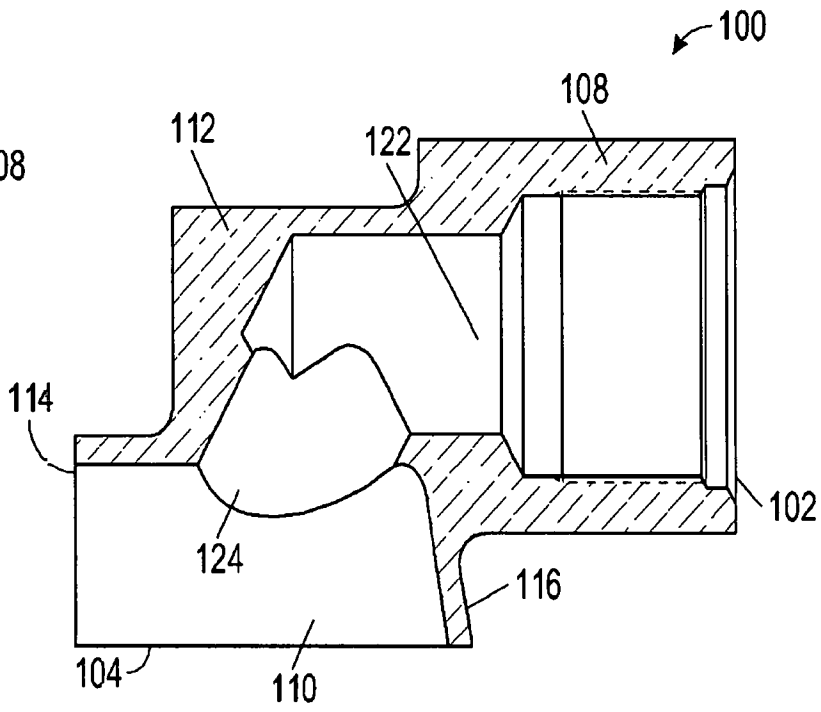
FIG. 8 is a cross-sectional side view of the end cap fitting of FIG. 4 taken along section D-D, according to an embodiment of the invention.
Figure 7:
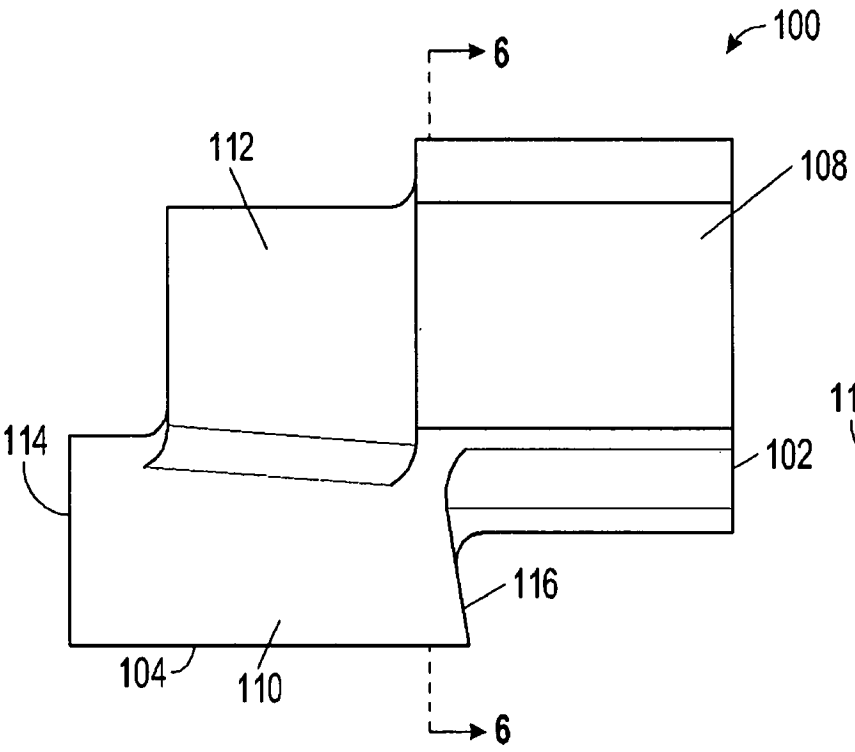
FIG. 7. is a side view of the end cap fitting of FIG. 4 according to an embodiment.

As shown in FIG. 5, the inlet section 108 includes a generally rounded portion 118 having a radius of about 0.870 inches (2.21 cm). The origin of the generally rounded portion 118 is vertically offset from the plane of the outlet end 104 by about 1.376 inches (3.495 cm). Flanges 120 are formed along opposing sides of the inlet section 108 such that a width extending between the origin of the rounded portion and each of the flanges 120 is about 1.012 inches (2.570 cm). The total width of the inlet section 108 is about 2.024 inches (5.141 cm). The flanges 120 extend about 0.590 inches (1.499 cm) in a first direction and about 0.410 inches (1.041 cm) in a second direction, perpendicular to the width of the inlet section 108 when measured from the origin of the rounded portion 118. The transition section 112 is generally cylindrical in shape and has a radius of about 0.570 inches (1.448 cm). The outlet section 110 includes a radius of about 0.912 inches (2.316 cm). The origin of the outlet section 110 is offset from the origin of the inlet section 108 such that a width measured between the edge of a flange 120 and the origin of the outlet section 110 is about 1.149 inches (2.918 cm).

A bore 122 having a minor diameter of about 0.875±0.005 inches (2.225±0.0127 cm) extends about 2.250±0.015 inches (5.715±0.0381 cm) from the inlet end 102 through both the inlet section 108 and the transition section 112. The outlet section 110 of the end cap 100 is similarly hollow such that each of the walls that define the outlet section 110, such as the corner 116 for example, has a thickness of about 0.120 inches (0.305 cm). An opening 124 extends from the outlet section 110 to a portion of the bore 122 within the transition section 112 to fluidly couple the inlet section 108 and the outlet section 110. The opening 124 has a diameter of about 0.875±0.005 inches (2.225±0.0127 cm) and extends at about a 60° angle to the planar surface of the outlet end 104. In one embodiment, the opening 124 intersects the bore 122 at a distance of about 1.648 inches (4.186 cm) from the inlet end 102 of the end cap 100, measured along the central axis of the bore 122.

While the invention has been described in detail in connection with only a limited number of embodiments, it should be readily understood that the invention is not limited to such disclosed embodiments. Rather, the invention can be modified to incorporate any number of variations, alterations, substitutions or equivalent arrangements not heretofore described, but which are commensurate with the spirit and scope of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. An end cap configured for use with a recirculation heat exchanger of an aircraft environmental control system, comprising:

a body including an inlet section adjacent an inlet end, an outlet section adjacent an outlet end, and a transition section fluidly coupling the inlet section and the outlet section, the inlet section including a generally rounded portion having a radius of 0.870 inches (2.21 cm) and at least one flange formed at a side of the rounded portion, an exterior of the at least one flange being positioned at a distance of 1.012 inches (2.57 cm) from a central axis of the rounded portion, the inlet section including a bore extending therethrough, the bore narrowing with increasing distance from the inlet end.

2. The end cap according to claim 1, wherein the outlet section includes a radius of about 0.912 inches (2.316 cm), a central axis of the radius of the outlet section being positioned at a distance of about 1.149 inches (2.918 cm) from the exterior of the at least one flange.

3. The end cap according to claim 1, wherein a first flange is positioned adjacent a first side of the rounded portion and a second flange is positioned adjacent a second, opposite side of the rounded portion, a total width of the inlet section at the flanges being about 2.024 inches (3.141 cm) and the first and second flange extend 0.590 inches (1.499 cm) in a first direction perpendicular to a horizontal plane containing the central axis of the rounded portion and 0.410 inches (1.041 cm) in a second direction perpendicular to the horizontal plane.

4. The end cap according to claim 1, wherein the central axis of the rounded portion is offset from a plane of the outlet end by a distance of about 1.376 inches (3.495 cm), and the transition section has a radius of about 0.570 inches (1.448 cm).

5. The end cap according to claim 1, wherein an overall length of the end cap extending between the inlet end and an opposite surface of the end cap arranged parallel to the inlet end is about 3.363 inches (9.22 cm), a length extending between the inlet end and a furthest surface of the transition section arranged parallel to the inlet end is about 2.863 inches (7.27 cm), and an overall length of the inlet section is about 1.613 inches (4.097 cm).

6. The end cap according to claim 1, wherein a corner of the outlet section adjacent the inlet section is located at a distance of about 1.342 inches from a plane defined by the inlet end, the corner being arranged at an angle of about 10° relative to the plane of the inlet end.

7. The end cap according to claim 1, wherein the outlet section is generally hollow such that each wall that defines the outlet section has a thickness of about 0.120 inches (0.305 cm).

8. The end cap according to claim 1, wherein the bore extends through the inlet section and a portion of the transition section, the bore having a minor diameter of about 0.875±0.005 inches (2.225±0.0128 cm).

9. The end cap according to claim 8, wherein an opening extends through the outlet section and into the transition section , the opening having a diameter of about 0.875 ±0.005 inches (2.225 ±.0128 cm) and being fluidly coupled to the bore to provide a fluid flow path.

10. The end cap according to claim 9, wherein the opening extends at an angle of about 60° relative to a horizontal axis and intersects the bore at a distance of about 1.648 inches (4.186 cm) from the inlet end.

11. A recirculation heat exchanger of an aircraft environmental control system, composing:

a core configured for crossflow of a first fluid and a second fluid therethrough;

a fluid port operably connected to the core and configured to admit the second fluid into the recirculation heat exchanger; and an end cap operably connected to the fluid port to direct the second fluid into the fluid port, the end cap including:

a body including an inlet section adjacent an inlet end, an outlet section adjacent an outlet end, and a transition section fluidly coupling the inlet section and the outlet section, the inlet section including a generally rounded portion having a radius of 0.870 inches (2.21 cm) and at least one flange formed at a side of the rounded portion, an exterior of the at least one flange being positioned at a distance of 1.012 inches (2.57 cm) from a central axis of the rounded portion, the inlet section including a bore extending therethrough, the bore narrowing with increasing distance from the inlet end.

* * * * *